US008721104B2

(12) United States Patent
Liao

(10) Patent No.: US 8,721,104 B2
(45) Date of Patent: May 13, 2014

(54) HAT WITH ANGLE ADJUSTABLE SOLAR POWERED LAMP

(75) Inventor: Sung-Yie Liao, Heping Shiang (TW)

(73) Assignee: Chuan Cheng Hat Co., Ltd., Taichung (TW)

( * ) Notice: Subject to any disclaimer, the term of this patent is extended or adjusted under 35 U.S.C. 154(b) by 285 days.

(21) Appl. No.: 13/423,312

(22) Filed: Mar. 19, 2012

(65) Prior Publication Data

US 2013/0242544 A1 Sep. 19, 2013

(51) Int. Cl.
*F21V 21/084* (2006.01)

(52) U.S. Cl.
USPC ..... 362/106; 362/249.11

(58) Field of Classification Search
CPC ..... F21Y 2101/02; F21V 21/084; F21V 21/0885; F21V 13/02
USPC ..... 362/106, 105, 249.11
See application file for complete search history.

(56) References Cited

U.S. PATENT DOCUMENTS 8,157,403 B2 * 4/2012 Lau ..... 362/106
8,474,995 B2 * 7/2013 Lau ..... 362/106
8,562,170 B2 * 10/2013 Sohn ..... 362/191

* cited by examiner

*Primary Examiner* — Vip Patel

(57) ABSTRACT

A hat is provided with a crown; a bill including a front recess; a lamp assembly including a hollow seat releasably secured to the recess, the seat including two side wings each having a through hole, two gears each around a portion of the hole, two guide grooves each on an outer surface of the wing, and two rear projections at both ends respectively wherein the guide grooves are slidably secured onto both sides of the recess and the projections are fitted in both ends of the cavity respectively; a mounting unit in the seat and including a receptacle and two hollow cylinders extending laterally to dispose in the holes respectively, each cylinder having an outer protrusion in gear engagement with the gear; and a lamp unit releasably secured to the mounting unit and including light emitting members; and a power supply electrically connected to the light emitting members.

6 Claims, 8 Drawing Sheets

HAT WITH ANGLE ADJUSTABLE SOLAR POWERED LAMP

BACKGROUND OF THE INVENTION

1. Field of the Invention

The invention relates to hats and more particularly to a hat having an angle adjustable solar powered lamp provided on a front portion of the hat's bill.

2. Description of Related Art

A hat is a head covering. It can be worn for protection against sunlight or rain, for ceremonial reasons, for safety, or as a fashion accessory. There is a type of hat having a lamp for illumination commercially available. However, a number of drawbacks have been found in the conventional hat. In detail, the lamp is secured to the front portion of the bill and its illumination direction is about parallel to the bill. Hence, a wearer has to pivot his/her head in order to adjust the illumination angle of the lamp. This is inconvenient. Further, the lamp is battery powered. It is often that the lamp may not emit sufficient light in use due to depletion of the battery. A frequent replacement or recharging of the battery is required. This is cumbersome. Furthermore, the battery is only for supplying power to the lamp. Other electric devices (e.g., mobile phones) cannot be charged by the battery due to no provision of appropriate ports or jacks on the battery. Thus, the need for improvement still exists.

SUMMARY OF THE INVENTION

It is therefore one object of the invention to provide a hat comprising a crown; a bill extending forward from the crown and comprising a front recess and a rear cavity communicating with the recess; a lamp assembly comprising a seat releasably secured to both the recess and the cavity, the seat including a front recessed portion, two side wings, two opposite holes through the wings respectively, two gears each formed around a portion of a circular inner surface of the hole, two guide grooves each formed on an outer surface of the wing, and two projections at both ends of a rear end respectively wherein the guide grooves are slidably secured onto both sides of the recess and the projections are fitted in both ends of the cavity respectively; a mounting unit disposed in the recessed portion of the seat and including a receptacle and two hollow cylinders extending laterally to dispose in the holes respectively, each cylinder communicating with the receptacle and having a lengthwise protrusion on an outer surface, the protrusion being in gear engagement with the corresponding gear so as to allow the mounting unit to pivot about the seat in a predetermined angular range; and a lamp unit releasably secured to the mounting unit and including a plurality of light emitting members; and a power supply electrically connected to the light emitting members.

The above and other objects, features and advantages of the invention will become apparent from the following detailed description taken with the accompanying drawings.

DETAILED DESCRIPTION OF THE INVENTION

Figure 1:
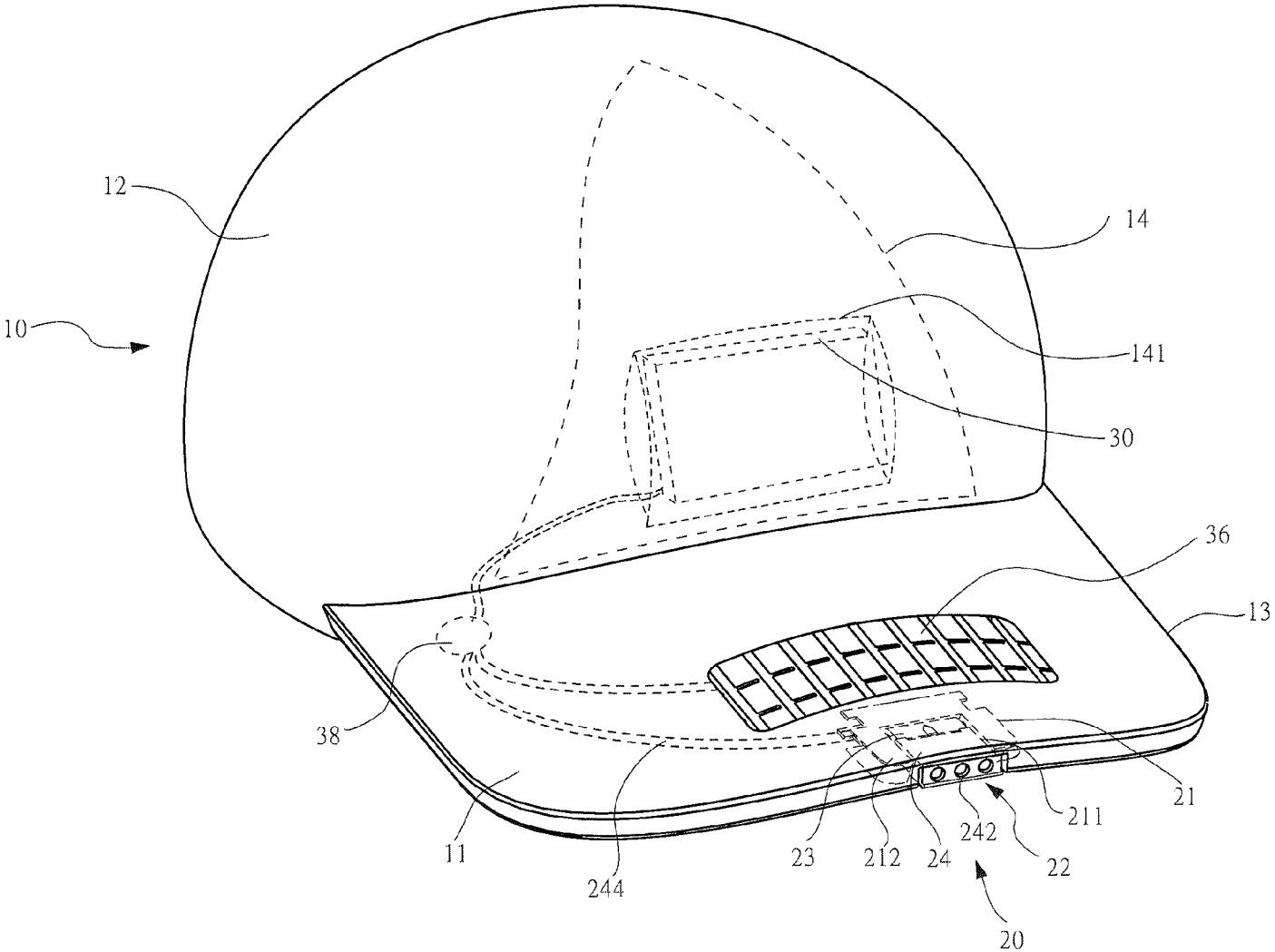
FIG. 1 is a perspective view of a hat according to the invention.
Figure 2:
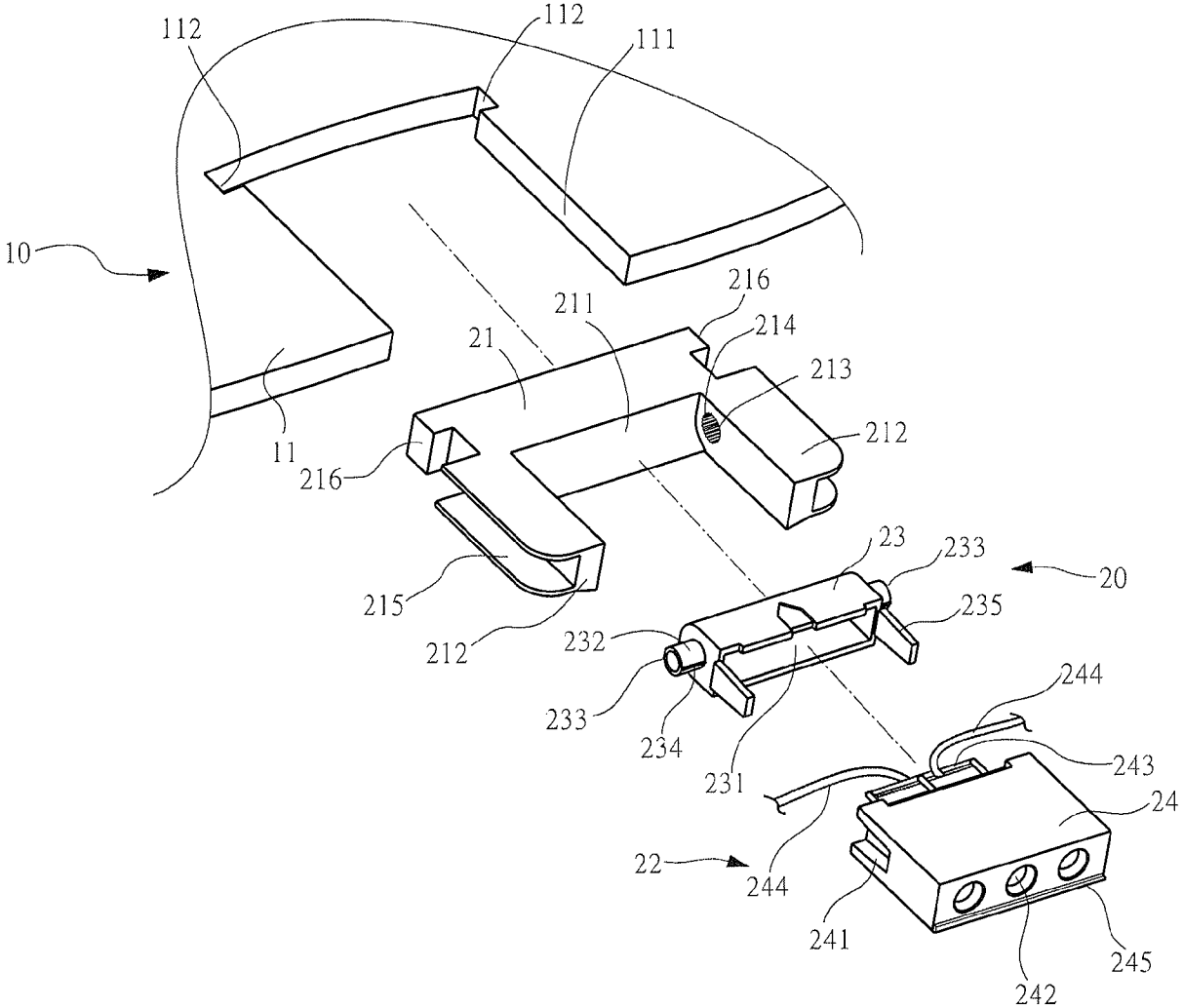
FIG. 2 is an exploded view of the solar powered lamp assembly of the hat.
Figure 3:
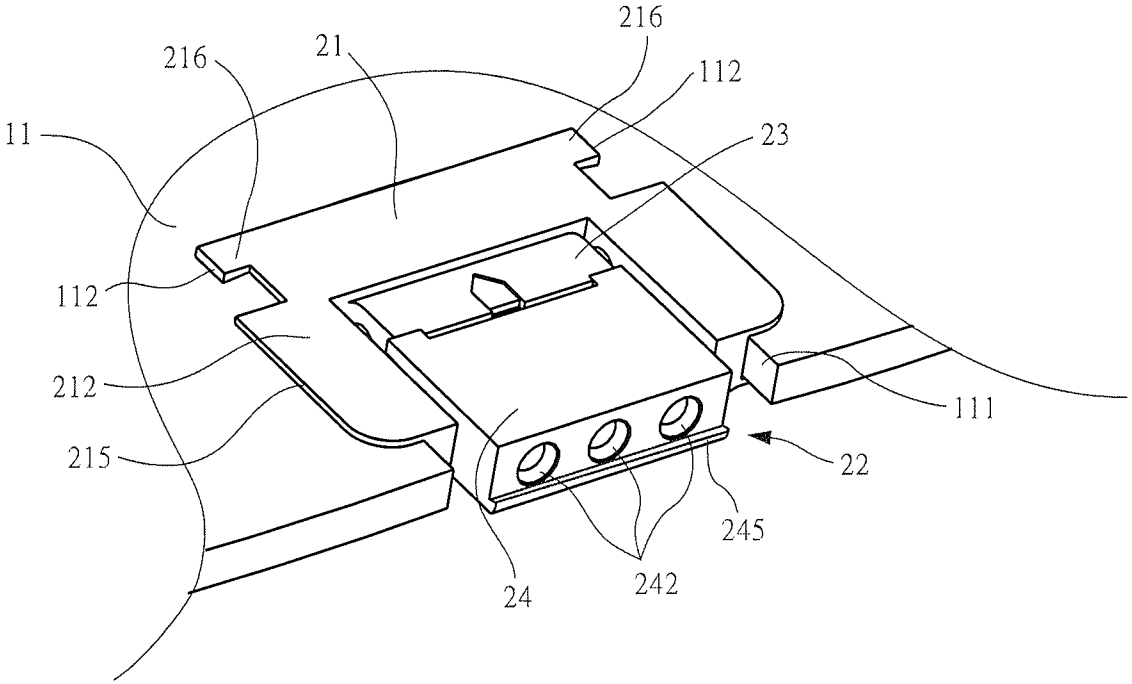
FIG. 3 is a perspective view of the assembled lamp assembly.
Figure 4:
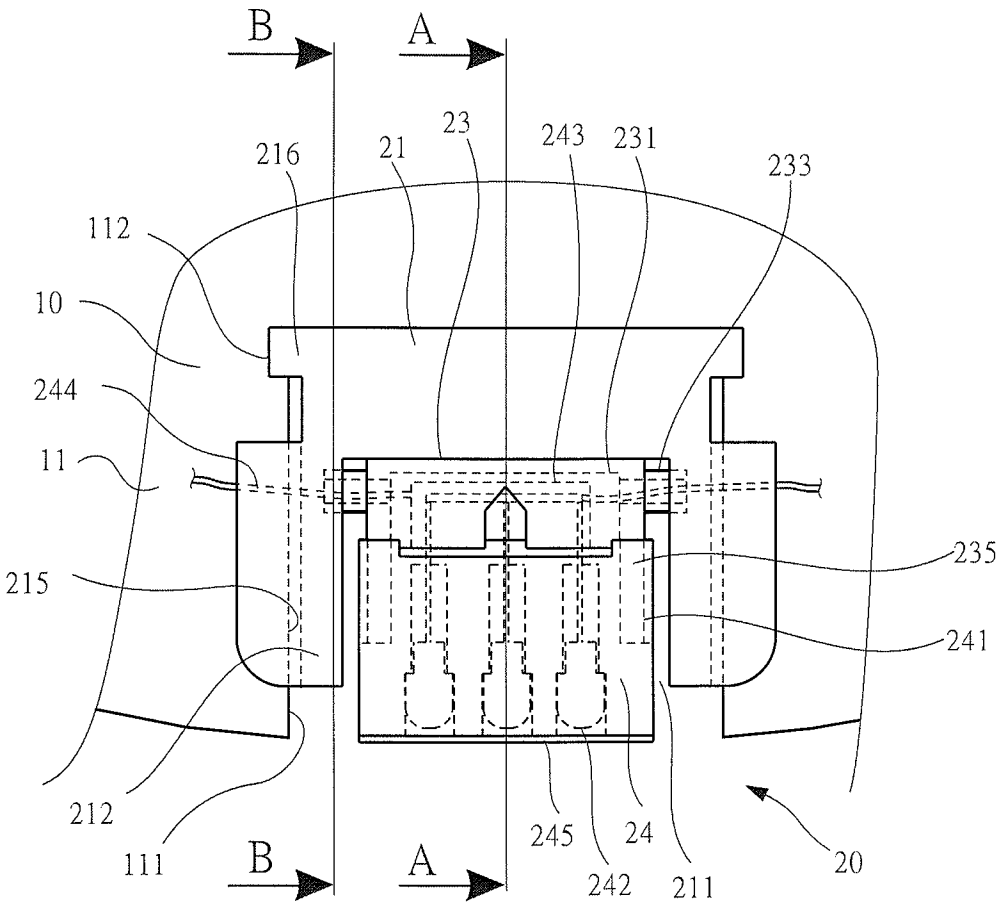
FIG. 4 is a top view of FIG. 3.
Figure 5:
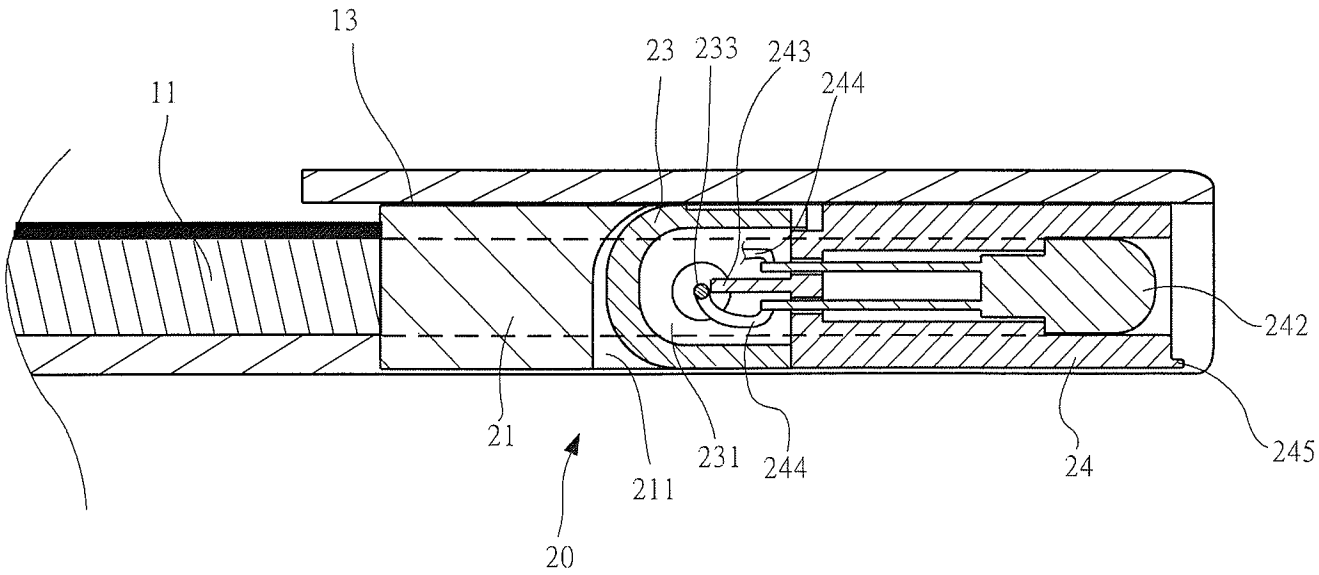
FIG. 5 is sectional view taken along line A-A of FIG. 4.
Figure 6:
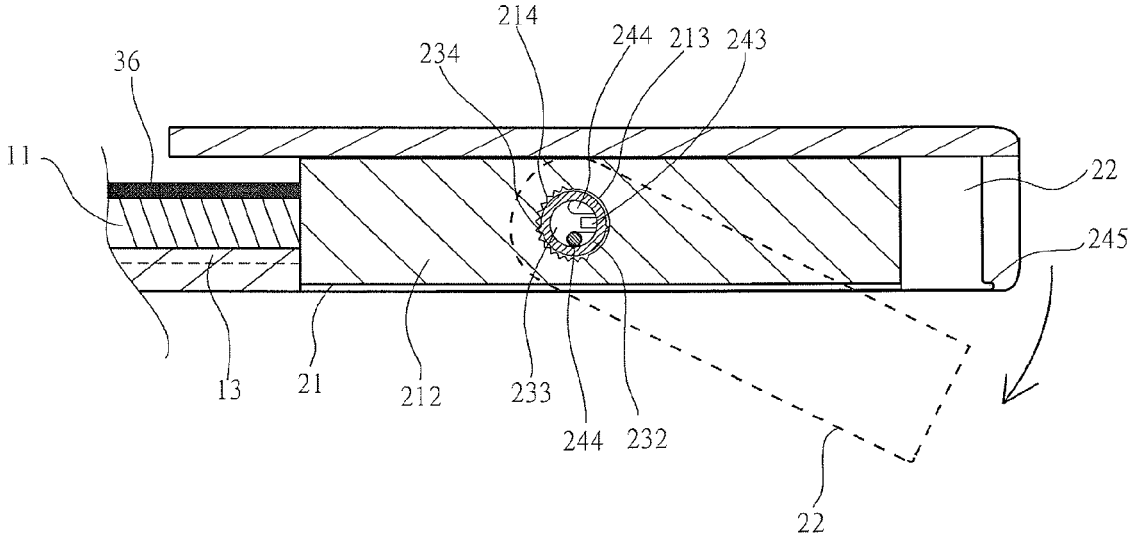
FIG. 6 is sectional view taken along line B-B of FIG. 4.
Figure 7:
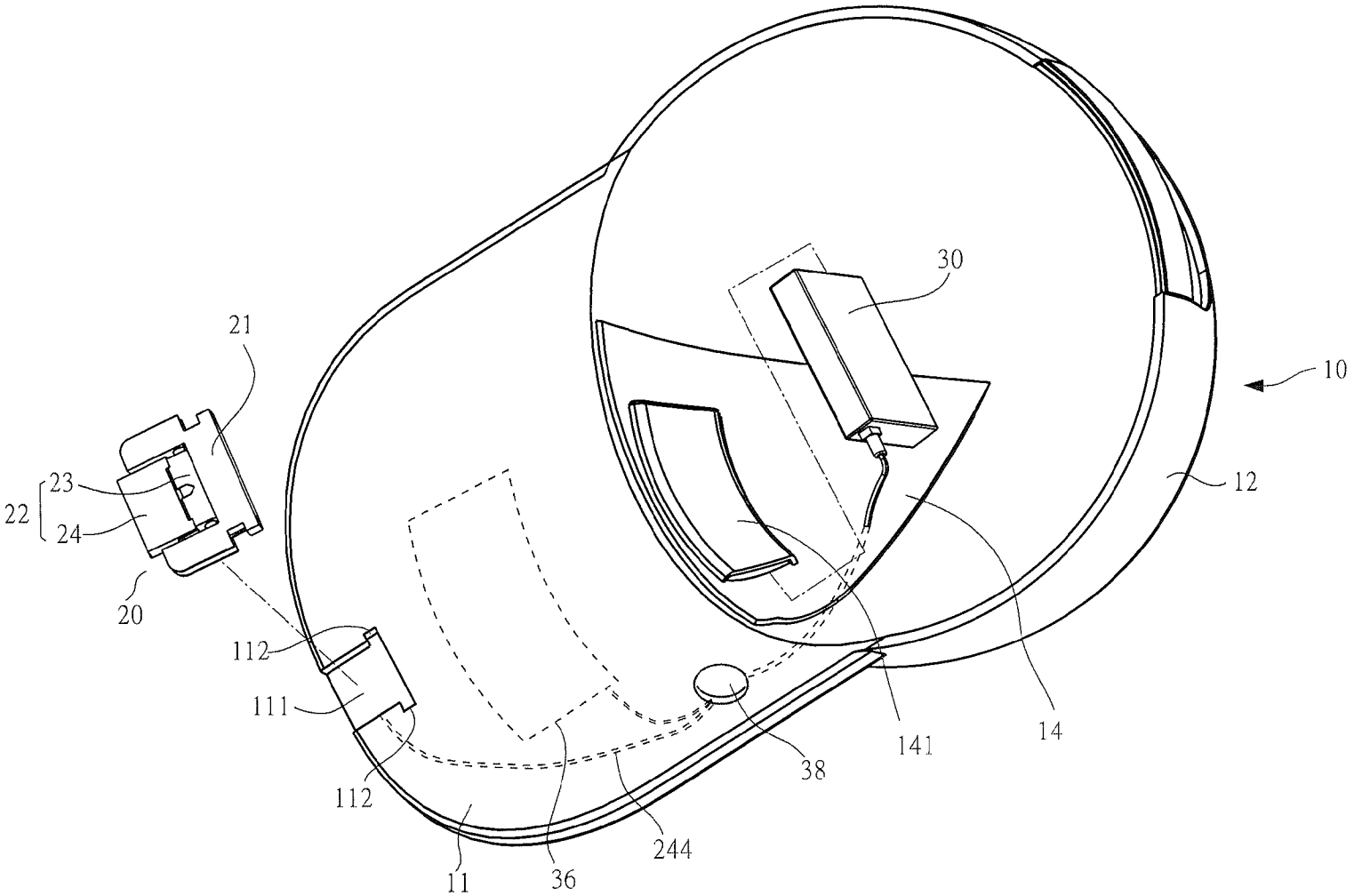
FIG. 7 is a bottom view of FIG. 1 with the lamp assembly and the battery assembly.
Figure 8:
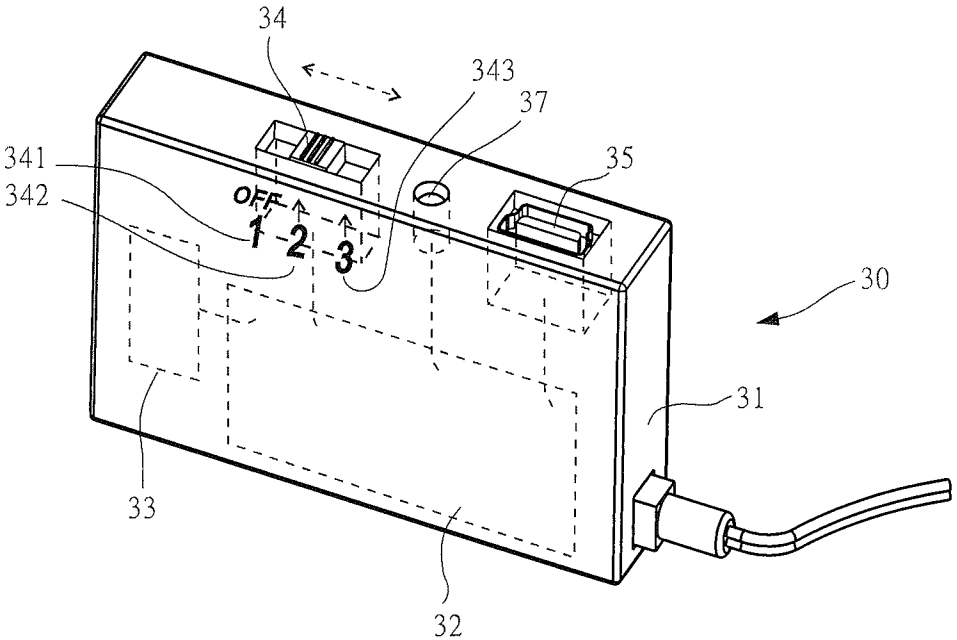
FIG. 8 is a perspective view of the battery assembly.

Referring to FIGS. 1 to 8, a hat (e.g., baseball cap) 10 in accordance with the invention comprises the following components as discussed in detail below.

A crown 12 and a stiff bill 11 extending forward from the crown 12 are provided. A fabric 13 is provided on top of the bill 11 as covering. In a front portion of the bill 11 there are provided a rectangular recess 111 on the front edge, and an elongated cavity 112 on a rear end of the recess 111. The cavity 112 has a width greater than that of the recess 111.

A lamp assembly 20 comprises a U-shaped seat 21 releasably secured to both the recess 111 and the cavity 112 by snapping, and a lamp 22 releasably secured to the seat 21. The seat 21 includes a recessed portion 211 open to a front end, two wings 212 on both sides respectively, two opposite holes 213 through the wings 212 respectively, two gears 214 each formed around a portion of a circular inner surface of the hole 213, two bifurcated guide grooves 215 each formed on an outer surface of the wing 212, and two projections 216 at both ends of a rear end respectively, the projection 216 being aligned with the corresponding guide groove 215. The guide grooves 215 can slide along both sides of the recess 111 to fit the projections 216 in both ends of the cavity 112 respectively. As a result, the seat 21 is held in place in the recess 111 and the cavity 112.

The lamp 22 comprises a mounting unit 23 and a lamp unit 24 releasably secured the mounting unit 23 as detailed later. The lamp 22 is shaped as a parallelepiped and adapted to fit in the recessed portion 211. The mounting unit 23 includes a receptacle 231 open to a front end, and two hollow cylinders 232 on both sides of a rear portion respectively, each cylinder 232 communicating with the receptacle 231 and having a bore 233 for allowing either wire 244 of the lamp unit 24 to pass, and a lengthwise protrusion 234 on an outer surface. The protrusion 234 engages the tooth of the corresponding gear 214. Thus, an individual may pivot the lamp 22 about the holes 213 (i.e., the seat 21) by clockwise or counterclockwise rotating the lamp 22 a desired angle in a tooth-by-tooth step. It is noted that an angle of the lamp 22 with respect to the seat 21 can be maintained after the pivoting due to the gear engagement of the protrusions 234 and the teeth of the gears 214.

The mounting unit 23 further comprises two side inserts 235 of trapezoidal tapered toward the front. The lamp unit 24 is about a parallelepiped and comprises two side wells 241 each shaped to complimentarily receive the inserts 235 to secure the mounting unit 23 and the lamp unit 24 together, a plurality of (three are shown) parallel light emitting members 242 provided in the front, a dividing plate 243 extending rearward to divide the receptacle 231 into upper and lower portions, the two wires 244 extending rearward to pass through the cylinders 232 to leave the lamp assembly 20 in which one wire 244 has one end connected to the positive terminals of the light emitting members 242 by pass through the upper portion of the receptacle 231, and the other wire has one end connected to the negative terminals of the light emitting members 242 by pass through the lower portion of the receptacle 231, and a protuberance 245 provided along bottom of the front end. The protuberance 245 is a slip resistant member so as to facilitate above angle adjustment of the lamp 22 by the hand.

A power supply 30 comprises a solar panel 36 provided on an intermediate portion of a top of the fabric 13 for converting the energy of light directly into electricity, and an electric switch 38 electrically connected to the solar panel 36 and the wires 244 respectively. The switch 38 can be operated to turn on the light emitting members 242, turn off the light emitting members 242, or flash the light emitting members 242.

A resilient layer 14 formed of foam or the like is stitched to an inner surface of the crown 12. A pouch 141 is formed between the resilient layer 14 and the crown 12 for disposing the remaining components of the power supply 30 therein.

The power supply 30 further comprises a parallelepiped housing 31 with the following components of the power supply 30 contained therein or thereon. The power supply 30 further comprises a control circuit board 32 electrically connected to the switch 38, a rechargeable battery (e.g., lithium cell) 33 electrically connected to the control circuit board 32, a sliding switch 34 on one side, the sliding switch 34 being electrically connected to the control circuit board 32, a port 35 on the same side as the sliding switch 34 and being electrically connected to the control circuit board 32, and an indicator 37 electrically connected to the control circuit board 32.

The sliding switch 34 can be slid to dispose in an off position 341 which disconnects the battery 33 from the control circuit board 32, an operating position 342 in which electricity is supplied from the solar panel 36 (or an external power source via the port 35) to the battery 33 for charging, and the light emitting members 242 are activated to illuminate by the battery 33, or in an output position 343 in which power of the battery 33 is supplied to an electronic device (e.g., mobile phone, MP3 player, or the like) via the port 35. The indicator 37 is lit when the sliding switch 34 is in the operating position 342 or the output position 343.

While the invention has been described in terms of preferred embodiments, those skilled in the art will recognize that the invention can be practiced with modifications within the spirit and scope of the appended claims.

What is claimed is:

1. A hat comprising:

a crown;

a bill extending forward from the crown and comprising a front recess and a rear cavity communicating with the recess;

a lamp assembly comprising a seat releasably secured to both the recess and the cavity, the seat including a front recessed portion, two side wings, two opposite holes through the wings respectively, two gears each formed around a portion of a circular inner surface of the hole, two guide grooves each formed on an outer surface of the wing, and two projections at both ends of a rear end respectively wherein the guide grooves are slidably secured onto both sides of the recess and the projections are fitted in both ends of the cavity respectively; a mounting unit disposed in the recessed portion of the seat and including a receptacle and two hollow cylinders extending laterally to dispose in the holes respectively, each cylinder communicating with the receptacle and having a lengthwise protrusion on an outer surface, the protrusion being in gear engagement with the corresponding gear so as to allow the mounting unit to pivot about the seat in a predetermined angular range; and a lamp unit releasably secured to the mounting unit and including a plurality of light emitting members; and a power supply electrically connected to the light emitting members.

2. The hat of claim 1, wherein the mounting unit further comprises two side inserts, and wherein the lamp unit comprises two side wells each being complimentary to the inserts for allowing the mounting unit and the lamp unit to releasably secure together.

3. The hat of claim 1, wherein the lamp unit further comprises a dividing plate extending rearward to divide the receptacle into first and second portions so that positive terminals of the light emitting members pass through one of the first and second portions of the receptacle and negative terminal of the light emitting members pass through the other of the first and second portions of the receptacle.

4. The hat of claim 1, wherein the power supply comprises a housing, a control circuit board, a rechargeable battery electrically connected to the control circuit board, a solar panel disposed on the bill for converting energy of sun directly into electricity to be stored in the rechargeable battery, a sliding switch electrically connected to the control circuit board, and a port electrically connected to the control circuit board, the port being for electricity input or output; and wherein the sliding switch is disposed in an off position, an operating position, or an output position.

5. The hat of claim 1, further comprising a resilient layer disposed on an inner surface of the crown, and a pouch formed between the resilient layer and the crown for disposing the housing of the power supply therein.

6. The hat of claim 1, wherein the lamp unit further comprises a protuberance along bottom of the front end.

* * * * *